United States Patent [19]

Goldfarb et al.

[11] 3,936,053

[45] Feb. 3, 1976

[54] TOY VEHICLE TARGET GAME

[75] Inventors: Adolph E. Goldfarb, Tarzana; Erwin Benkoe, Encino; Delmar K. Everitt, Woodland Hills; Ronald F. Chesley, La Crescenta; Richard D. Frierdich, Canoga Park, all of Calif.

[73] Assignees: Adolph E. Goldfarb; Erwin Benkoe, both of Northridge, Calif.

[22] Filed: Feb. 10, 1975

[21] Appl. No.: 548,695

[52] U.S. Cl. ..... 273/108; 46/44; 46/206; 124/13 R; 273/95 R

[51] Int. Cl.[2] ..... A63H 17/00

[58] Field of Search ..... 46/1 K, 44, 74 B, 202, 46/206; 273/95 C, 86 D, 108, 119 B, 95 R; 124/13 R, 14, 15

[56] References Cited

UNITED STATES PATENTS

| | | | |
|---|---|---|---|
| 2,327,702 | 8/1943 | Flynt | 273/95 R |
| 2,409,653 | 10/1946 | Amdur | 46/44 |
| 2,692,592 | 10/1954 | Lawson | 124/13 R |
| 2,733,699 | 2/1956 | Krinsky | 46/74 B |
| 2,803,922 | 8/1957 | Holt | 46/202 |
| 3,046,694 | 7/1962 | Holderer | 46/44 |
| 3,121,292 | 2/1964 | Butler et al. | 46/74 B |
| 3,262,440 | 7/1966 | Kuhn | 124/15 |
| 3,739,764 | 6/1973 | Allport | 46/74 B |
| 3,740,896 | 6/1973 | Glass et al. | 46/44 |

*Primary Examiner*—Anton O. Oechsle
*Assistant Examiner*—Harry G. Strappello
*Attorney, Agent, or Firm*—Robert M. Ashen; Robert J. Schaap

[57] ABSTRACT

A toy vehicle target game including a propelling apparatus to propel a toy vehicle, as for example a miniature car, toward a selected target. The propelling apparatus employs a pneumatically operable ejector which propels the toy vehicle by pneumatic fluid under pressure, and includes an aiming device for directing the car from a ramp associated with the propelling apparatus toward the target.

14 Claims, 4 Drawing Figures

TOY VEHICLE TARGET GAME

This invention relates in general to certain new and useful improvements in toy vehicle target games, and, more particularly, to toy vehicle target games where a toy vehicle is propelled by a propelling apparatus toward a remote target.

There have been a number of commercially available toy vehicle sets where a toy vehicle, such as a miniature car, is propelled by means of fluid flow, as for example air movement. In these conventional toy sets, the launcher is pneumatically operable and may include a bellows with some form of manually operable actuating member. Thus, the launcher may be provided with a handle to push down on the bellows and thereby move an air mass through a relatively long tube. The toy vehicle is operatively connected in removable fashion to the bellows so that the air will drive the vehicle. However, one of the interesting aspects of this form of toy is that air flow as opposed to air pressure created the driving force.

Another type of prior art toy vehicle set relied upon an air driven turbine which was operable by a hand pump. In this case, the toy vehicle was propped up on a flywheel and when the air driven turbine was pumped with the desired amount of pressure, the rear wheel of the toy vehicle was lowered to the ground or other supporting surface so that it was propelled through the action of the air driven turbine.

A further type of prior art toy set relied upon a water or other liquid exhaust. In this case, the toy vehicle was provided with a pump so that air pressure could be pumped against a diaphragm interface between a water chamber and an air chamber. After the air was pumped to a desired pressure, the air would force the water or other liquid out of a nozzle and thereby provide a liquid jet action to drive the toy vehicle.

The present invention obviates these and other problems associated with commercially available toy vehicle games by providing a toy vehicle in the form of a miniature car which is provided with a plug on one end thereof. The toy vehicle game also includes a propelling apparatus in the form of a cylinder having a central chamber for pressurizing air within the chamber by means of a manually operable piston. The vehicle is located in a guideway and the plug on the vehicle extends through a nozzle or fitting in the wall of the cylinder that communicates with the central chamber.

One of the major problems initially encountered in the toy vehicle set of the present invention is that the plug on the miniature car is not ideally retained within the aperture formed in the chamber. Thus, in some cases, the car would tend to be ejected prematurely, before the maximum amount of design pressure has been created in the chamber, which thereby propels the vehicle only over a relatively short path, or otherwise with a relatively slow speed, or both. In other cases, the plug may fit too tightly within the aperture communicating with the chamber such that the car would not be ejected when the desired threshold pressure level is achieved within the chamber.

The present invention overcomes this problem in that when the piston is pushed inwardly to compress air within the chamber, and at the end of its travel, it will engage a pivotally mounted ejector mechanism which mechanically engages the plug to initially break the seal between the nozzle and the plug. Thereafter, the pressurized air within the chamber will propel the car through the guideway toward a remote target. A sighting device may also be provided on the guideway to aim the miniature car toward a selected target.

It is, therefore, the primary object of the present invention to provide a toy vehicle target game which is designed to propel a toy vehicle from a propelling apparatus with a proper preselected amount of fluid under pressure.

It is another object of the present invention to provide a toy vehicle target game of the type stated which permits aiming of the vehicle and proper ejection of the vehicle toward the target.

It is a further object of the present invention to provide a toy vehicle target game of the type stated in which the target is remote from the propelling apparatus and the target and may adopt the form of various obstacles or stunts for the car to navigate and which thereby introduces an element of skill for the player.

It is also an object of the present invention to provide a toy vehicle target game of the type stated which is durable in its construction and capable of withstanding the abuse normally subjected by small children.

It is another salient object of the present invention to provide a toy vehicle target game of the type stated which is relatively safe and can be manufactured at a relatively low unit cost.

With the above and other objects in view, our invention resides in the novel features of form, construction, arrangement and combination of parts presently described and pointed out in the claims.

Having thus described the invention in general terms, reference will now be made to the accompanying drawings in which:

Figures 1, 2, 3:
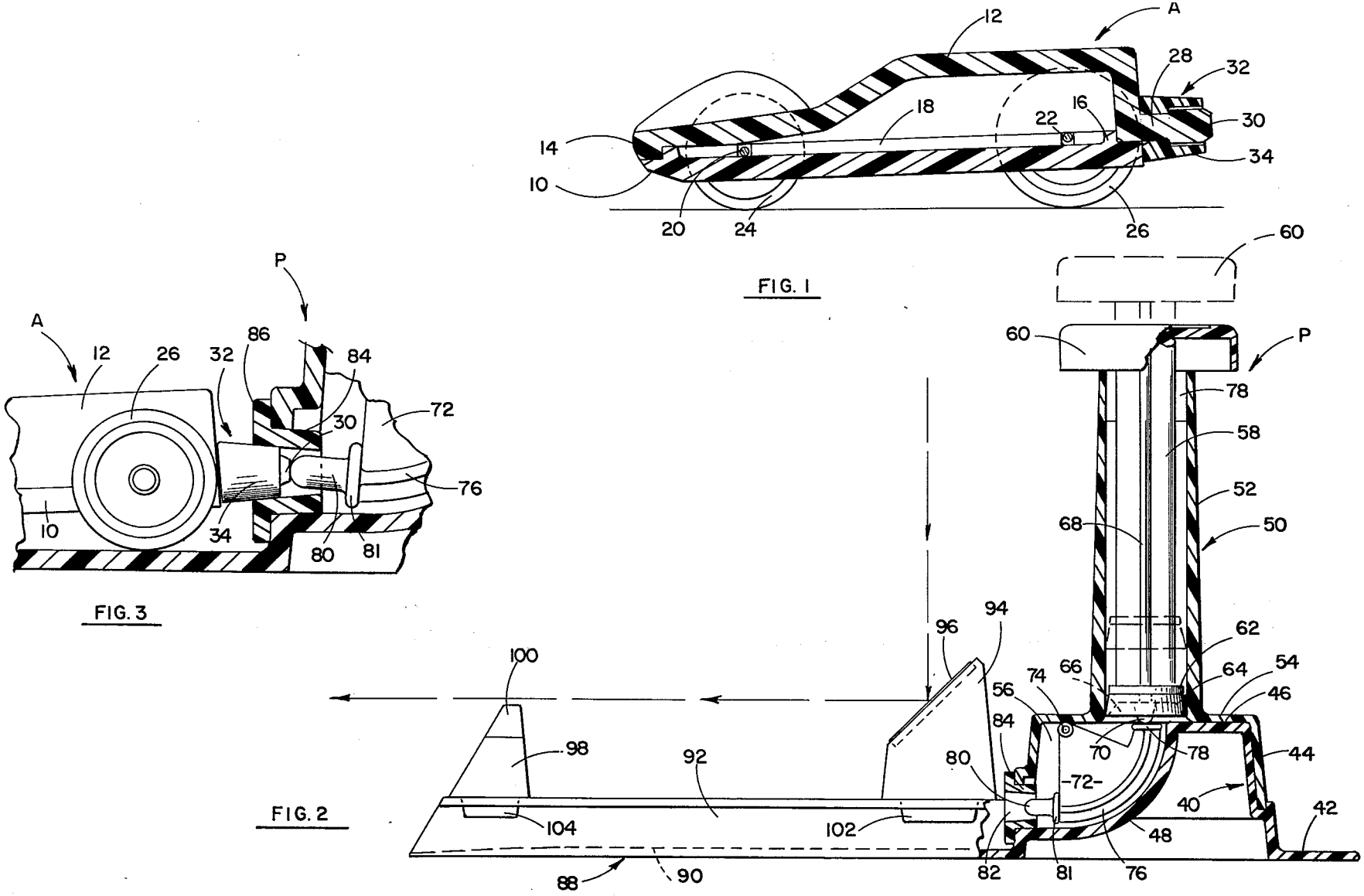
FIG. 1 is a vertical sectional view showing the overall construction of a toy vehicle used in a toy vehicle target game of the present invention.
FIG. 2 is a side elevational view, partially broken away and in section, of a propelling apparatus used in the toy vehicle target game of the present invention.
FIG. 3 is an enlarged side elevational view, partially broken away and in section, and showing the connection of the toy vehicle to the propelling apparatus.

Referring now in more detail and by reference characters to the drawings, A designates a toy vehicle, in the form of a miniature car, including a base frame 10 and a body 12 secured to the base frame. In this case, the body 12 could be suitably designed with an outer appearance to resemble a toy racing vehicle or similar toy vehicle, as desired. The body 12 is secured to the base frame 10 by means of locking fit between forward and rearward upstanding flanges 14 and 16 integrally formed with the base frame 10.

The base frame 10 is also provided with a pair of transversely spaced apart, longitudinally extending, upwardly projected flanges 18, which are provided with forward and rearward grooves to accommodate and retentively hold a front axle 20 and a rear axle 22. Mounted on each of the ends of the front axle are a pair of front wheels 24, and similarly mounted on each of the opposite ends of the rear axle 22 are rear wheels 26. The actual mechanism used to secure the wheels 24 and 26 to the vehicle A can adopt any of a variety of forms, and the one form of construction shown herein, while preferred, is indeed not the only technique for rotatably mounting the wheels to the vehicle A.

Integrally formed with the rearward end of the body 10 is a rearwardly projecting hub 28 having an enlarged head 30. Fixedly mounted on the hub 28 is a sleeve 32 which serves as a plug having a diametrally reduced inner flange 34 for locking about the enlarged head 30, and in the manner as illustrated in FIG. 1 of the drawings.

The various components of the toy vehicle A, with the exception of the plug 32, can be formed of a number of known plastic materials, such as polyethylene, polystyrene, polybutadiene, any of a number of known vinyladiene copolymers, etc. These components can also be formed in any of a number of well known plastic-forming operations, including injection molding, blow molding, thermo-forming, etc. However, it should also be understood that other materials could be used in the formation of the vehicle A, including lightweight metals and the like.

The plug 32 may also be formed of any of a number of known plastic or similar forms of materials, the important criteria with respect to the plug 32 being that the plug must be somewhat resilient. In this case, the plug must be sufficiently resilient to literally serve as a sealing member in an air chamber, in a manner to be hereinafter described. One of the preferred materials used in the formation of the plug 32 is polyethylene. It also should be observed that the plug 32 is provided with a rearwardly and inwardly tapered outer wall 34, and is also slightly shorter in the axial dimension than the hub 28, so that the head 30 projects outwardly from the plug 32.

Figure 4:
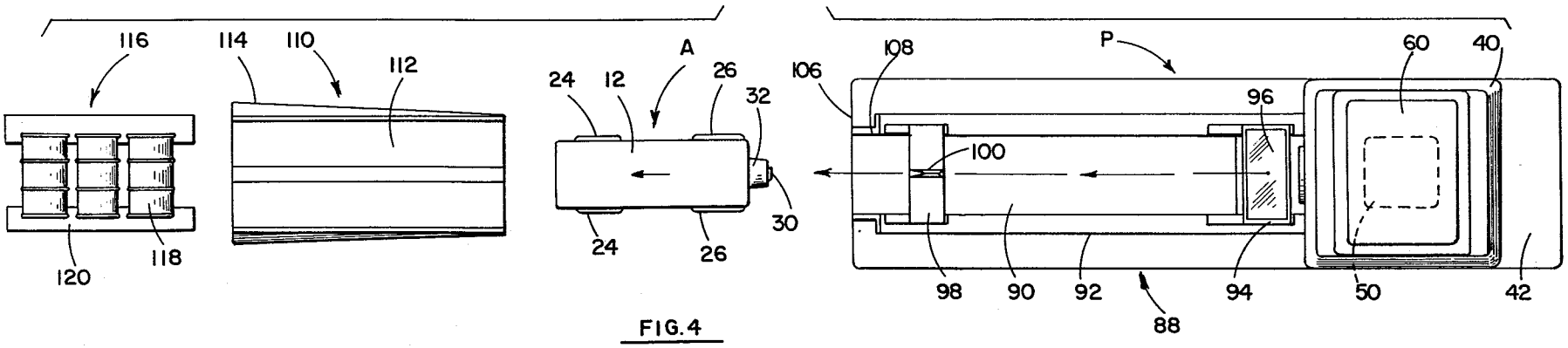
FIG. 4 is a schematic top plan view showing the movement of a toy vehicle from the propelling apparatus toward a remote target.

The toy vehicle target game of the present invention also provides a propelling apparatus P, which is more fully illustrated in FIGS. 2–4 of the drawings. The propelling apparatus P includes a base housing 40, which is integrally formed with a horizontally disposed, outwardly struck and peripherally extending base foot 42, for support on a floor or other similar form of supporting surface. The base 40 also includes a somewhat vertically disposed side wall 44, which integrally merges into one section of the base foot 42, a top wall 46, and an arcuately shaped side wall 48, which also integrally merges into another section of the peripherally extending base foot 42, for reasons which will presently more fully appear.

A pressurizing mechanism 50 is secured to the base housing 40 and includes a vertically disposed cylinder 52 which integrally merges at its lower end into an enlarged cap 54, the latter being fixedly retained on the base housing 40 in the manner as illustrated in FIG. 2 of the drawings. Any suitable mechanism of securing the cap to the base housing 40 may be used in accordance with the present invention. However, it can be observed that the arcuate side wall 48 and one portion of the cap 54 form a fluid chamber 56, also as more fully illustrated in FIG. 2 of the drawings.

Shiftably disposed within the cylinder 52, and also forming part of the pressurizing mechanism 50, is a vertically shiftable plunger 58 which functions as a piston. The piston 58 is provided at its upper end with an enlarged cap 60 which is capable of being engaged by the hand of the operator, namely a player of the game. Thus, when the operator wishes to compress a fluid, such as air under pressure in the chamber 56, the player of the game merely pushes downwardly on the cap 60, often referred to as the "handle."

As its lower end, the plunger 58 is provided with a piston head 62 which is formed of a fairly rigid member. Secured to the piston head, and extending downwardly therefrom, is a packing 64 in the form of a cylindrical sleeve which is formed of a fairly resilient material and is tapered downwardly and outwardly to engage the interiorly presented cylindrical surface of the cylinder 52. The packing 64 is provided with a recess 66 on its downwardly presented surface. In this way, when the plunger 58 is urged downwardly by manual pressure on the handle 60, air will force the lowermost end of the packing 64 outwardly in snug fitting, sealing engagement with the interiorly presented surface of the cylinder 52. In this way, a fairly effective fluid-tight seal is created between the packing 64, and hence the piston head 62, with respect to the interiorly presented side wall of the cylinder 52. Consequently, the air within the chamber 56 will become compressed as the plunger 58 is pushed downwardly.

Also secured to the handle 60 and extending axially within the plunger 58, is an actuating rod 68 which is fixed to the handle 60, and hence moves with the plunger 58. The actuating rod 68 is provided on its lower end with an enlarged head 70. By further reference to FIG. 2 of the drawings, it can be observed that the enlarged head 70 extends below the piston head 62 so as to engage a pivotally movable, actuating member, or so-called "ejector" 72.

By further reference to FIG. 2, it can be observed that the ejector 72 is pivotally mounted on the cap 54 by means of a pivot pin 74, and is located within the chamber 56. The ejector 72 essentially comprises an arcuately shaped section and is reinforced by a stiffening rib 76. Furthermore, the ejector carries an enlarged boss 78 which is engageable by the enlarged head 70 in order to shift the ejector 72 about the pivot pin 74 when then plunger 58 reaches its lowermost position of travel. In this respect, and by further reference to FIG. 2, it can be observed that the piston or plunger 58 can be shifted from an initial position, that is an uppermost position, as schematically illustrated by the phantom lines in FIG. 2, to a lowermost position where the cap 60 engages the upper end of the cylinder 52, and in which latter position would constitute the lowermost position of the piston 58. In the same respect, it should be observed that the plunger 58 could be shifted for almost the entire vertical dimension of the cylinder 52 and will be limited at its uppermost end of travel by means of a plug 78 located at the upper end of the cylinder 52.

The ejector 72 also includes an ejector head 80 which is formed with an enlarged rearwardly presented flange 81. The cap 54 is provided with a nozzle 84 which is tapered rearwardly and inwardly, reference being made to FIG. 2 of the drawings. In this case, it can be observed that the enlarged ejector head 80 extends within the nozzle 82 and the movement thereof would be limited by the head flange 81. In addition, it can be observed that the nozzle 82 is sized and shaped to accommodate the plug 32 on the vehicle A. Moreover, and by reference to FIG. 3 of the drawings, it can be observed that when the piston 58 reaches its lowermost limit of travel, the enlarged head 70 will engage the flange 78 and cause the actuator 72 to pivot about the pivot pin 74 in a clockwise direction. As this occurs, the enlarged ejector head 80 will engage the head 30 on the vehicle A and break the sealing engagement between the plug 32 and the nozzle 82. In this latter respect, it can be observed that the nozzle 82 is formed by a cylindrical styrene tubular member 84 having an enlarged flange 86 which buts against the cap 54 and the base housing 40 in the manner as more fully illustrated in FIG. 3 of the drawings.

The base housing 40 is integrally provided with a forwardly extending guideway 88, which is provided with a horizontally disposed base supporting track 90 often referred to as a guideway. This guideway 90 is provided with a pair of upwardly extending guide flanges 92, extending along the opposite sides thereof. The left end, or forward end, of the guideway, reference here being made to FIG. 2, is open so that the vehicle A may be ejected outwardly from the guide track 90, which in this case is slightly tapered downwardly at its forwardmost end. In this respect, it can be observed that the guideway 90 integrally merges into a portion of the base flange 42, in the manner as more fully illustrated in FIGS. 2 and 3 of the drawings.

Snap-fitted into the rearward end of the flanges 92 forming part of the guideway 88 is a bracket 94 having a sighting glass 96 disposed at approximately a 45° angle with respect to the guideway 90. Located at the forward end of the guideway 88 is a bracket 98 having a bifurcated sighting element 100. The bracket 94 and the bracket 98 are both secured to the pair of opposed spaced apart flanges 92 by means of downwardly extending tabs 102 and 104, respectively, which fit within slots (not shown) within the flanges 92. In accordance with the above construction, it can be observed that the player of the game can observe the image in the sighting glass 96 which is located at a 45° angle with respect to a remote target (hereinafter described) and locate the position of the propelling apparatus P and, hence, the automotive vehicle A with respect to the remote target through the sighting glass 96 and the sighting alignment element 100.

The vehicle A can be located within the guideway 88 and supported on the guide track 90, in the manner as illustrated in FIG. 4 of the drawings. In this respect, it should be observed that the guideway 88 is provided with a pair of inwardly extending guide flanges 106 at its forwardmost end to insure the proper propelling of the vehicle A in the selected direction and attitude. It can be observed that the vehicle A has its wheels 24 and 26 located slightly outwardly of the body 12 so that they will very slightly, but nevertheless relatively frictionally free, engage the inner margins 108 of the flanges 106 to insure proper direction of the vehicle as it is propelled from the propelling apparatus P. In this respect, the wheels 24 and 26 could be located inwardly of the body 12 and the frame 10 and could be substituted by means of guide flanges which extend outwardly from the body 12.

Located remotely from the guideway 88 is a ramp 110 which also includes a horizontally disposed ramp surface 112 and a pair of opposed, spaced apart and relatively parallel retaining flanges 114. This ramp 110, as well as a target element 116, constitute the total target. The target element 116, in this case, constitutes a plurality of barrels 118 retained by a pair of spaced apart and parallel retaining brackets 120.

The target 110 could adopt any form of element or remote target area in which the vehicle A is to be directed. Moreover, it should be understood that a plurality of targets 110 could be located in aligned arrangement and retained on a simple frame so that the player of the game could propel the vehicle A toward any of the selected target areas within the entire target, in order to maintain a selected score.

In use, it can be observed that the player of the toy vehicle set will locate the vehicle A in the guideway 88 so that the plug 28 extends into the nozzle 82 in snug, fluid-sealing engagement therewith. Thus, when the player of the game wishes to direct the vehicle A toward the target 110, the player will merely push downwardly on the handle 60 and force the piston 58 downwardly. As this occurs, the air in the chamber 56 will be pressurized. It can be observed that the vehicle will not be ejected until the the actuating head 82 actually engages the enlarged head 30 on the plug 34. Consequently, it should be recognized that the vehicle could be pushed rearwardly so that the plug 32 is inserted into the nozzle 84 with any desired amount of force. Nevertheless, the pressure which is created in the chamber 56 is not the initial release force to release the plug 32 from the nozzle 82.

Actually, the enlarged head 80 on the ejector mechanism 72 engages the enlarged head 30 and physically urges the plug 32 outwardly of the nozzle 82. As this occurs, the air under pressure within the chamber 56 will force the vehicle A away from the propelling apparatus P and through the guideway 88. Inasmuch as the player of the game will attempt to properly align the guideway 88 with respect to the remote target 110, the player can score points, or otherwise win the game, by properly directing the vehicle A over the ramp 112 and over the target elements 116.

Thus, there has been illustrated and described a unique and novel toy playing set which fulfills all of the objects and advantages sought therefor. It should be understood that many changes, modifications, variations, and other uses and applications could be made by those skilled in the art after considering this specification and the accompanying drawings. Therefore, any and all such changes, modifications, variations and other uses and applications which do not depart from the nature and principle of the invention are deemed to be covered by the invention which is limited only by the following claims.

Having thus described our invention, what we desire to claim and secure by letters patent is:

1. A toy vehicle set comprising:

a. a toy vehicle comprised of:
   1. frame means
   2. a plurality of wheels operatively mounted on said frame means,
   3. a plug operatively located with respect to said vehicle and being formed of a somewhat resilient material, b. a propelling apparatus comprised of:
   1. a fluid chamber,
   2. piston means movable with respect to said chamber to compress a fluid in said chamber, and where said piston means moves from a first position where said fluid is uncompressed to a second position where said fluid is compressed,
   3. a nozzle operatively communicating with said chamber and being sized to removably accept said plug in fluid-tight engagement,
   4. shiftable actuating means operatively mounted in said chamber and being shiftable when said piston means shifts to the second position,
   5. said actuating means being located to be shifted to engage said plug when said piston means reaches said second position and thereby break the seal between said plug and said nozzle to permit the compressed fluid to propel said vehicle.

2. The toy vehicle set of claim 1 further characterized in that said plug is formed of a somewhat resilient seal-forming material.

3. The toy vehicle set of claim 1 further characterized in that said fluid chamber is formed by a housing, a cylinder is connected to said housing in communication with said chamber and said fluid is air.

4. The toy vehicle set of claim 3 further characterized in that said piston means is manually shiftable in said cylinder.

5. The toy vehicle set of claim 1 further characterized in that said actuating means is a pivotal member engagable by said piston and said pivotal member having a projection on one side thereof which extends into said nozzle to engage said plug.

6. The toy vehicle set of claim 1 further characterized in that a guideway extends from said chamber to guide said vehicle in a path when propelled by said propelling apparatus.

7. The toy vehicle set of claim 6 further characterized in that sighting means is located with said guideway to sight the guideway and vehicle toward a remote target.

8. A toy vehicle target game comprising:

a. a propelling apparatus comprised of:

1. a guideway
2. a pneumatically operable drive means located in relation to said guideway for driving a vehicle under pneumatic pressure,
3. sighting means disposed in operative relationship to said guideway to guide a vehicle toward a target,
4. mechanical release means for initially releasing said vehicle to enable said drive means to propel the aforesaid vehicle, b. a movable vehicle disposable in said guideway and capable of being driven therefrom by the pneumatic pressure, c. and a target remote from said vehicle toward which said vehicle is aimed.

9. The toy vehicle target game of claim 8 further characterized in that said vehicle comprises a plug thereon, and said drive means comprising a movable actuating means which carries said mechanical release means and which engages said plug to initially release said vehicle.

10. The toy vehicle target game of claim 8 further characterized in that said toy vehicle is a toy car.

11. The toy vehicle target game of claim 8 further characterized in that said sighting means is a sighting glass on said guideway and a target alignment element on said guideway remote from said sighting glass.

12. The toy vehicle target game of claim 8 further characterized in that said vehicle comprises a plug thereon, and said drive means comprises:

a. a fluid chamber, b. piston means movable with respect to said chamber to compress a fluid in said chamber, and where said piston moves from a first end position where said fluid is uncompressed to a second end position where said fluid is fully compressed, c. a nozzle operatively communicating with said chamber and being sized to removably accept said plug in fluid-tight engagement, d. and shiftable actuating means operatively mounted in said chamber and being operatively engaged by said piston when said piston shifts to the second position.

13. The toy vehicle target game of claim 12 further characterized in that said actuating means is located to be shifted to engage said plug when said actuating means is operatively engaged by said piston, and thereby break the seal between said plug and said nozzle to permit the compressed fluid to propel said vehicle.

14. The toy vehicle target game of claim 8 further characterized in that said plug is formed of a somewhat resilient seal-forming material.

* * * * *